US009719255B1

(12) United States Patent
Ehsani

(10) Patent No.: US 9,719,255 B1
(45) Date of Patent: Aug. 1, 2017

(54) BUCKLING REINFORCEMENT FOR STRUCTURAL MEMBERS

(71) Applicant: Mohammad Reza Ehsani, Tucson, AZ (US)

(72) Inventor: Mohammad Reza Ehsani, Tucson, AZ (US)

( * ) Notice: Subject to any disclaimer, the term of this patent is extended or adjusted under 35 U.S.C. 154(b) by 0 days.

(21) Appl. No.: 14/742,423

(22) Filed: Jun. 17, 2015

(51) Int. Cl.

| | |
|---|---|
| ***E04C 3/04*** | (2006.01) |
| ***E04C 3/32*** | (2006.01) |
| ***B28B 23/00*** | (2006.01) |
| ***B28B 7/06*** | (2006.01) |
| ***B28B 7/34*** | (2006.01) |
| ***E04G 13/04*** | (2006.01) |
| *E04C 3/02* | (2006.01) |

(52) U.S. Cl.
CPC ..... *E04C 3/04* (2013.01); *B28B 7/06* (2013.01); *B28B 7/346* (2013.01); *B28B 7/348* (2013.01); *B28B 23/0068* (2013.01); *E04G 13/04* (2013.01); *E04B 2103/02* (2013.01); *E04B 2103/06* (2013.01); *E04C 2003/026* (2013.01)

(58) Field of Classification Search
CPC ..... E04C 3/04; E04C 2003/026; B28B 7/06; B28B 7/346; B28B 7/348; B28B 23/0068; E04B 2103/02; E04G 13/04
See application file for complete search history.

(56) References Cited

U.S. PATENT DOCUMENTS

| | | | | |
|---|---|---|---|---|
| 2,874,546 A * | 2/1959 | Fox | E02D 13/10 | 403/283 |
| 3,086,273 A * | 4/1963 | Welborn | E04C 5/08 | 106/823 |
| 3,397,260 A * | 8/1968 | Lamberton | E02D 5/60 | 249/1 |
| 3,516,213 A * | 6/1970 | Sauer | E04B 1/944 | 52/474 |
| 4,019,301 A * | 4/1977 | Fox | E04B 1/642 | 405/216 |
| 4,281,487 A * | 8/1981 | Koller | E04H 9/021 | 248/351 |
| 4,347,019 A * | 8/1982 | Metz | E02D 5/30 | 405/255 |
| 5,908,049 A * | 6/1999 | Williams | E21B 17/206 | 138/125 |
| 5,921,285 A * | 7/1999 | Quigley | D04C 1/06 | 138/114 |

(Continued)

*Primary Examiner* — Jeanette E Chapman
(74) *Attorney, Agent, or Firm* — Arjomand Law Group, PLLC

(57) ABSTRACT

A method and an article of manufacture are disclosed for externally reinforcing various solid structures, such as columns, poles, piles, beams and the like, against buckling under compressive forces and loads. In various embodiments, a seamless multi-layer jacket is constructed around the structural member by wrapping a thin sheet of material around the structural member, as many times as needed, at a distance from the structural member. While maintaining the thin sheet of material wrapped around the structural member, a filler material will fill the annular space between the jacket and the structural member, wherein the structural member, the jacket, and the filler material cooperate to better resist the buckling of the structural member when subject to compressive forces and loads.

10 Claims, 7 Drawing Sheets

(56) References Cited

U.S. PATENT DOCUMENTS

| | | | | |
|---|---|---|---|---|
| 6,242,070 | B1 * | 6/2001 | Gillispie | E01F 15/141 428/122 |
| 7,513,564 | B2 * | 4/2009 | Yamazaki | B62D 29/002 296/187.02 |
| 8,267,262 | B2 * | 9/2012 | Thelwell | B65G 1/02 211/183 |
| 2002/0020136 | A1 * | 2/2002 | Mueller | E04B 1/2604 52/707 |
| 2004/0145215 | A1 * | 7/2004 | Taguchi | B61D 17/08 296/187.02 |
| 2010/0218708 | A1 * | 9/2010 | Carr | E04G 23/0218 109/83 |

* cited by examiner

BUCKLING REINFORCEMENT FOR STRUCTURAL MEMBERS

CROSS-REFERENCE(S) TO RELATED APPLICATION(S)

This non-provisional application is related to U.S. provisional patent applications No. 61/998,097 filed on 19 Jun. 2014, the disclosure of which is hereby expressly incorporated by reference in its entirety, and the benefit of the priority date of which is hereby claimed under 35 U.S.C. §119(e).

TECHNICAL FIELD

This application relates generally to the field of construction. More specifically, this application relates to buckling restrained compression columns and braces that are used in construction of frames in structures subjected to loads such as those induced by gravity, traffic, earthquakes, blast and explosion, strong winds and the like.

BRIEF DESCRIPTION OF THE DRAWINGS

The drawings, when considered in connection with the following description, are presented for the purpose of facilitating an understanding of the subject matter sought to be protected.

DETAILED DESCRIPTION

While the present disclosure is described with reference to several illustrative embodiments described herein, it should be clear that the present disclosure should not be limited to such embodiments. In addition, while the following description references using thin steel and/or FRP (Fiber Reinforced Polymer) sheets to reinforce structural columns and braces, it will be appreciated that the disclosure may include fewer or more laminate sheets of the same or other kinds and materials to reinforce columns and braces and/or other types of structures, such as walls, chambers, beams, and the like, against buckling. Furthermore, while the following description references using adhesive between the overlapped layers of these sheets to prevent them from unwrapping, it will be appreciated that the disclosure may include other methods of securing a wrapped sheet around a structural member.

Briefly described, a method and an article of manufacture are disclosed for externally reinforcing structural members susceptible to buckling, such as columns, poles, beams, braces, truss members and the like, which are constructed from various materials including but not limited to steel. In an example embodiment, the disclosed buckling restrained column or brace comprises: a core member, usually made of steel, having two opposite ends; a multi-layer jacket member comprising a thin structural sheet, usually made of steel or FRP, coated with an adhesive and wrapped around the core member to create the multi-ply jacket that is not bonded to the core member; a sealing agent, usually a type of resin, to seal the ends of the jacket together; and a filler material to fill the space between the jacket and the core member, wherein the combination of the core member, the jacket, and the filler material provides greater resistance to buckling of the core member when the column or brace is subjected to static and/or dynamic compressive forces. A structural sheet in the context of the present disclosure is defined as a sheet of material with high tensile capacity at least in one direction, such as a thin metal sheet or a one or two dimensional fiber reinforced polymer.

Figure 1:
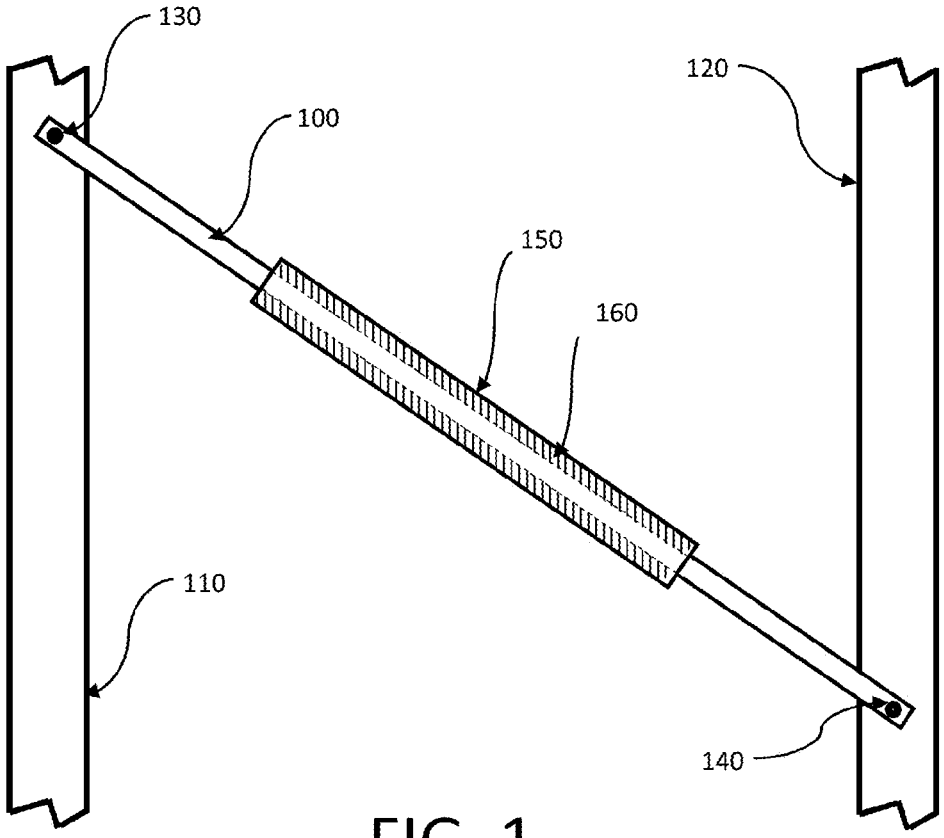
FIG. 1 shows an example of a buckling restrained brace with a steel core member connected between two columns, wherein the steel core member is reinforced against buckling by a reinforcement jacket and a filler material inside the jacket.

FIG. 1 shows an example of a buckling restrained brace with a steel core member 100 that is attached—in this case pivoted—between two columns 110 and 120 at pivot points 130 and 140, wherein the steel core member 100 is reinforced against buckling by reinforcement jacket 150 and the filler material 160 inside jacket 150. Throughout this specification, pivoting is merely an example of any kind of connection. In different embodiments the ends of some columns or braces may be welded, glued, riveted, bolted, screwed, or the like.

Some of the various structural members susceptible to buckling may be used to support buildings, bridges, floors, utility and electrical power lines and the like. In some embodiments, some of these structural members may be hollow. In other embodiments multiple layers of various sheets may be wrapped around the core member, which is vulnerable to buckling, to form an external solid shell or jacket; restraining lateral movements of any wrapped section of the core member with respect to the other wrapped sections. The wrapped multiple layers, which may be thin sheets of steel and/or FRP or any other material including plastic and aluminum, constitute an important part of the structural reinforcement against buckling. In some embodiments, if needed, spacers may be placed between the structural member and the jacket to create a space for pouring filler materials such as concrete, grout, epoxy, or other similar reinforcing material.

Structural repair can be expensive, cumbersome, and time consuming. Structures can get damaged due to a variety of factors, such as earthquakes, overloading, weight of traffic, wear and tear, corrosion, explosions, and the like. Prevention is generally more cost-effective than repair. As such, it is generally easier and more cost-effective to strengthen a structure that may be exposed to damaging forces and loads, than waiting to repair such eventual damages after they occur or to replace the structure with a new one. Intentional damage inflicted upon infrastructure, by terrorism or vandalism, is another way that structural damage may result. For example, recently, there has been growing interest to strengthen the above-mentioned structures for blast loading, such as terrorist attacks, which may seek to blow up a building, a bridge, a pipe and the like, by placing a bomb adjacent to the structure and detonating it. In addition to prevention, if damage does occur to a structure, a cost-effective and speedy method of repair is clearly desirable.

The capacity of structural elements such as steel columns and braces is often limited by the buckling of the member. As an example, a very short steel column or "stub" will fail at a very high axial load due to the yielding of the steel while, in contrast, a taller steel column with the same cross section will fail under a much smaller load, due to buckling of the column. In general, due to buckling, the taller or the more slender the column, the smaller the load-carrying capacity. This load is referred to as the buckling load or buckling capacity of the column.

In nearly all structures made with metals such as steel, the capacity of the columns and braces is governed by the buckling capacity of these elements. This results in an underutilization and inefficient use of the materials. There is a great interest in developing compression members (e.g. columns and braces) that would fail by yielding of the materials rather than buckling at a fraction of the yielding capacity. While the focus of this application is on bracing elements of the structures, the same advantages can be realized in other structural elements subjected to axial loads such as columns, legs of offshore oil platforms, and the like.

Braces are frequently used in construction of steel frames. They are frequently made of steel profiles of various shapes such as angles, tubes, wide flanges, etc. As the building is subjected to lateral loads, these braces resist compression or tension loads depending on the direction of the lateral load. As mentioned above, the capacity of a steel brace is much lower in compression than in tension due to buckling which reduces the compression capacity by failing the brace well before it reaches its yield strength.

Braced frames are an effective solution for limiting lateral displacement of building stories. Regardless of the arrangement of braces in braced frames (diagonal, chevron, etc.), the overall strength and stability of the lateral-force resisting system depends mainly on the performance of the structural braces. The "buckling restrained brace" frame (BRBF) is a highly ductile seismic-force resisting system intended primarily for special seismic applications. The principal advantage of the buckling restrained brace is that the brace does not buckle, so the brace strength is similar under compression and tension loading, which leads to significantly lighter framing members especially when compared to "special concentric braced frames" (SCBF). Another advantage of the buckling restrained brace frame is that the brace connections are relatively small and compact in comparison to the connections or special concentric braced frames.

In buckling restrained braces (BRB), flat steel plates and/or bar materials are used to create a unique configuration that is made up of a yielding steel core made from steel plate or bar, as the load resisting element. The yielding steel core is confined against buckling between steel web plates welded to two steel flange plates in an "I" shape configuration. To limit the deformation of the steel core the web plates are placed in close proximity to the steel core, with only a very nominal gap provided by natural unevenness of the steel material. Additional friction reducing material, a liner or a thin coating may be applied to the steel core contact surfaces and to the surrounding web members to reduce friction and facilitate movement of the steel core.

Specialized manufacturing equipment is utilized including automatic computerized plate cutting technology and automatic submerged arc welding equipment to effectively fabricate a brace. With the exception of a small weld or bolt located, for example at mid-length, to secure the core to the webs, the yielding steel core is not connected directly to the restraining elements in order to allow for independent movement of the load resisting core relative to the restraining brace elements.

The currently available state of the art buckling restrained braces (BRB) are designed primarily for high rise buildings and other structures where large lateral loads are involved, most commonly to resist lateral earthquake loads. The technology disclosed herein differs from conventional buckling-restrained braces in that it is lighter, more economical, and is designed primarily for retrofit of ordinary braces in existing structures to convert them into stronger BRB.

Current state of the art buckling-restrained braces utilize conventional hot roll shapes, usually HSS tubes or pipes filled with mortar, concrete, or other non-compressible filler material to restrain the load resisting steel core against buckling. One of the disadvantages of the conventional buckling restrained braces compared to the disclosed method is that the conventional brace is made from steel elements only, welded in a specific configuration to allow the steel core to be continuously restrained by, yet move independent of, the restraining steel elements.

When conventional structural braces are subject to high axial forces the braces may reach various forms of local and global buckling that can lead to reduced strength and stiffness, and degraded performance, even collapse, especially under cyclic loading resulting, for example, from an earthquake. In contrast to conventional braces, the buckling-restrained brace exhibits stable and predictable behavior under cyclic loading. With these braces the impact of an earthquake can be absorbed or reduced, and the frame lateral displacement reduced to an acceptable level. The principle difference is in the unique arrangement of elements of the buckling-restrained brace assembly that will allow plastic deformation of its inner core while at the same time prevent buckling within the member or its end connections. Consequently, the continuously braced inner core element will elongate or compress during loading cycles and the brace will achieve nearly equal strength and stiffness under axial compression and tension loading.

Figure 2:
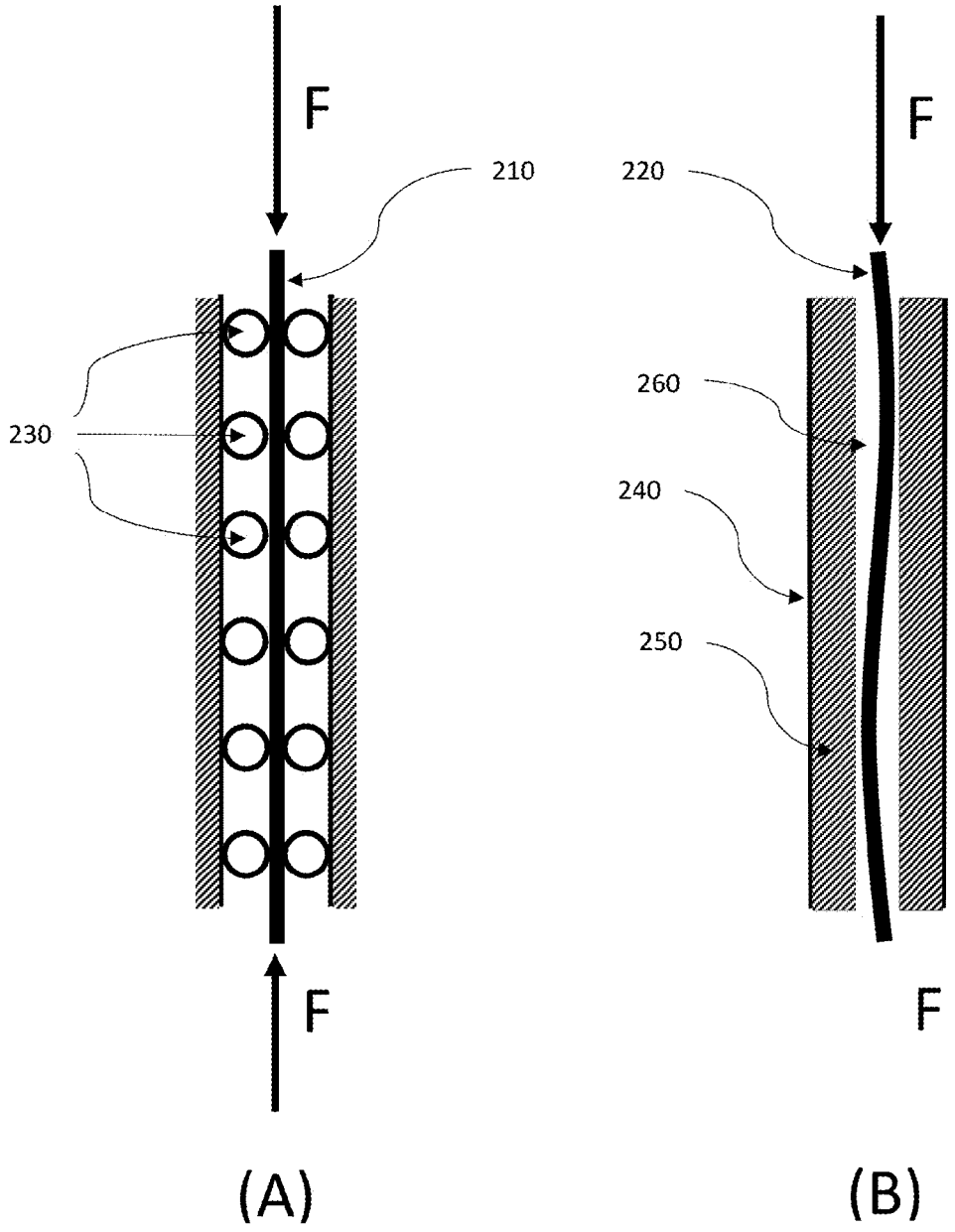
FIGS. 2A and 2B schematically illustrate how a column under axial compression may be reinforced against buckling.

To assure the above described behavior, the brace assembly must allow for free movement of the inner core with respect to the restraining apparatus along the brace length. This relative movement can be facilitated with a variety of friction reducing materials or coatings, or an air-gap. FIGS. 2A and 2B schematically illustrate how a column under axial compression may be reinforced against buckling. FIG. 1A shows lateral support for steel core 210 by rollers 230, which are preferably placed between inflection points of a few primary buckling modes. FIG. 2B illustrates a more practical way of buckling restraint in which the steel core 220 is surrounded by jacket 240 and the space between jacket 240 and core 220 is filled with filler material 250, such as concrete, and the filler material 250 is prevented from sticking to the core 220 by bond-preventing layer 260.

The concept of Buckling Restrained Brace (BRB) was introduced in the late 1990s. Buckling Restrained Braced Frames (BRBF) offer an alternative to conventional braced frames which surpasses their energy dissipation capacity and thus is cost-effective. Conventional steel bracing element shows unsymmetrical behavior under cyclic loading: on one hand, it is characterized by high ductility in tension due to the ductile yielding material characteristics; on the other hand, its performance is governed by buckling under compression. The stability problem influences the overall cyclic response of the element, reflected by the cyclic degradation. Excluding the buckling phenomenon—that is the basic idea of BRB—leads to a balanced, extremely ductile and dissipative cyclic behavior as illustrated below.

The three major components in a BRB are (1) steel core, (2) bond-preventing layer; and (3) casing. As known to those skilled in the art, when a BRB is loaded in compression, as soon as the steel core buckles and moves laterally, it encounters the steel casing which stops this lateral movement. This forces the steel core to take more loads and buckle in the next higher mode of buckling. This process continues until finally the cross section reaches its compressive yield strength.

BRB and BRBF have seen increased use in recent years. Several companies have tested and developed their own proprietary systems. One of these companies established in 2002 is CoreBrace, LLC that commenced research and development of their Buckling-Restrained braces in February of 2001. In October of 2001, the first series of half scale BRB specimens were successfully tested per the AISC/SEAOC Recommended Provisions for Buckling Restrained Braced Frames (Provisions) at the University of Utah. From spring to fall of 2002, two more series of specimens were tested at the University of Utah for brace sizes ranging from 65 to 340 kips. All of these test specimens exceeded the Provisions by large margins. The company has tested some of the largest BRBs to date.

Peter Dusicka of Portland State University has introduced a lightweight Aluminum BRB which is wrapped with FRP (US 20150000228, WO2013103878). Among the advantages of his invention is the light weight and non-corroding nature of both aluminum and FRP. Among the limitations of his invention is the higher cost of aluminum and the fact that the product can be used only in new construction; it does not offer any solution for millions of existing buildings that require seismic upgrade.

All of the above mentioned solutions require a tube or shell that will encase the brace, and because these tubes must be pre-manufactured, they can only be used in the construction of new BRBs. In other words, because the ends of an existing brace are connected to the building frame, one cannot slip a pre-fabricated jacket or tube over the steel brace. This is a major limitation that prevents the above techniques to be used in retrofit of exiting conventional steel braces. Once a steel brace has been erected (as in millions of existing buildings), the above techniques cannot be implemented to convert the ordinary steel brace to a BRB.

While the present disclosure is described with reference to several illustrative embodiments described herein, it should be clear that the present disclosure should not be limited to such embodiments. Therefore, the description of the embodiments provided herein is illustrative of the present disclosure and should not limit the scope of the disclosure as claimed. In addition, while the following description references using one or more layers of reinforcement laminate sheet to create a substantially cylindrical shell around a steel brace, it will be appreciated that the disclosure may include fewer or more layers of reinforcement sheets to reinforce other types of structures with various cross-sections, such as beams, slabs, walls, columns, landing gears in airplanes, piles, sheet piles, utility poles, silos, chimneys and the like.

To overcome the above mentioned shortcomings of the prior art, a new economical method of construction of BRB is described. This method can be applied to new construction as well as retrofit of bracing elements in existing buildings that were not constructed as a BRB.

In one embodiment, this method utilizes the PileMedic® SuperLaminate™ marketed through PileMedic, LLC of Arizona. These laminates are manufactured with specially designed equipment. A resin is applied to one or more layers of a composite fabric such as glass, carbon, basalt, Kevlar, etc. fabric and the entire assembly is put through the equipment where it is subjected to heat and pressure. The result is a very thin (0.01-0.03 inch) thick laminate. These laminates are very strong with tensile strength exceeding 150,000 psi. There are laminate that are also made with the same fabric sandwiched between two layers of a very thin glass veil. The glass veil provides a dielectric barrier allowing the laminate to be placed directly against a steel structure. In contrast if a carbon fabric is to be placed against a steel structure, it would result in galvanic corrosion. To prevent this, a layer of glass fabric is installed between the carbon FRP and the steel member. Another main advantage of these laminates is that the laminate has enough rigidity to stand on its edge by itself.

In one embodiment the PileMedic® jackets is wrapped around the column or brace at least two full turns plus a few inches of overlap or extension at the end. This provides a sufficiently large bonded or glued area that prevents premature failure of the jacket due to bond failure. When such a jacket is subjected to internal pressure as it applies a confining pressure to the grout that it surrounds, the jacket will fail in tension after its full capacity is reached rather than a premature failure due to slippage and bond failure of the epoxy layer. The number of the overlapping and bonded layers must be designed by the engineer based on the confinement requirements and it may be as little as a single layer (360 degrees) plus a few inches for the overlap to one that is comprised of several layers. In other embodiments, regardless of the number of layers used, only the overlapping edge of the jacket may be glued. In yet other embodiments the jacket may be constructed by spirally winding the laminate sheet around the column or brace. Spacers such as PVC pipe and the like can be used to define the cross-sectional shape of the jacket as the laminate sheet is being wrapped around the column. Therefore, the jacket does not have to be a cylindrical shape and its shape can be easily selected and economized by use of such spacers that can be left in place or pulled out once the annular space is filled with the filler material. In some embodiments, prior to placement of the filler material, reinforcing elements, such as steel or non-steel rebar, are placed in the annular space.

In various embodiments, the jacket can also be made of thin metallic sheets or plastic sheets such as HDPE, PVC, instead of the PileMedic® FRP laminates described above, and the like that have the right flexibility and stiffness that allows them to be wrapped or coiled around a conventional steel brace in an existing building and glued to themselves to build a multi-ply shell that can hold its shape. Examples of these products are thin sheet metals with thickness of less than 1 mm that can be coiled without difficulty. Similarly, sheets of HDPE and PVC with thicknesses less than 2 mm can be used for this purpose. Those skilled in the art realize that thicker HDPE or PVC sheets may be used but these may require slight heating of the sheet to make them more flexible during the installation so they can be bent into a smaller diameter. It is also recognized that thicker sheets may be easily installed around larger steel braces while thinner sheets are preferable for smaller braces.

Those skilled in the art will recognize that BRBs require that the grout does not adhere to the steel core. For this reason, a "Debonding Gap" must be provided between the filler material and the column or brace surface. In one embodiment, an unbonding material will be applied to the surface of the steel brace. This can be a variety of chemicals including but not limited to grease, mold release and the like.

It may also include thin films of materials that inhibit bonding of grout to the steel brace, such as Mylar, plastic films, shrink-wrap, etc. The purpose of these coatings is to prevent bonding of the concrete fill or grout to the surface of the steel core or brace.

In some embodiments PileMedic® SuperLaminate™ sheet is wrapped two or more times around the brace. A layer of epoxy paste such as QuakeBond™ J201TC, sold by Quakewrap of Arizona, is thoroughly mixed and applied to the surface of the laminate. As the laminate is wrapped around the steel column or brace the layers of the laminate are glued or bonded together. It is not necessary to cover the portion of the laminate that will be in immediate proximity to the surface of the steel column or brace. At this stage the laminate can be cinched tight and its size can be adjusted to create a multi-layered shell of desired shape and size around the steel column or brace. A ratchet strap or rope can be used to hold the shell in its desired shape until the epoxy cures. After or before the epoxy cures, the bottom of the shell is sealed and, for example, a concrete grout is placed in the shell, filling the entire space between the shell and the steel brace or column.

The tube or shell constructed according to this disclosure has no seam around its circumference so it has the same strength 360 degrees around the jacket. This is an important feature of this disclosure because such a shell can provide a significant confining pressure on the concrete or grout, making the grout much stronger than an unconfined grout. Those skilled in the art realize that the strength of the confined concrete is directly proportional to the amount of confining pressure provided by the shell. At the same time, the jacket prevents the buckling of the steel brace, making it significantly stronger under axial compressive loads.

FRP is not an isotropic material and has different strength in different directions depending on the orientation of the fibers in the FRP. In some embodiments, the SuperLaminate™ shell will have fibers in multiple directions including some fibers that will be aligned with the axis of the brace. These fibers provide a stress and force resultant that is along the axis of the brace or column, and will further contribute to the load resistance of the brace. In other embodiments the fibers can be primarily in the hoop direction (i.e. perpendicular to the axis of the brace) to provide high degrees of confinement for the grout and resistance against the buckling of the core.

In some of the embodiments, instead of a concrete or cementitious grout, an epoxy grout will be used. Those skilled in the art realize that these grouts are made by mixing a low-viscosity resin with filler materials such as sand, small gravel, etc. One of the advantages of such a grout is that it will bond (glue) better to the shell. When the jacket and grout are bonded together they act as a unit. The position of the "jacket and grout" as a single unit must be fixed along the length of the brace so that this assembly cannot freely slide up or down the length of the brace. To achieve this, in some embodiments at least one shear stud may be welded to the core of the brace prior to placement of the grout. Such stud will be embedded in the grout and will prevent free travel of the grout/jacket assembly along the axis of the brace. The stud can be either welded or it may be in the form of a bolt secured to the steel column by other means such as insertion through a cut hole in the column with or without the use of washers and nuts. Franken bolts are one such product.

Figure 3:
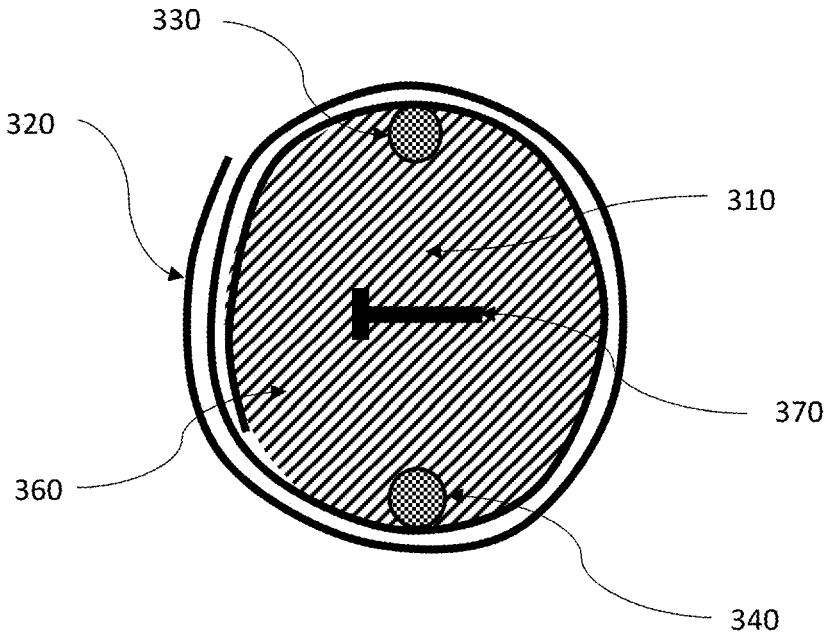
FIG. 3 shows an example cross-sectional view of a restrained column according to a presently disclosed method.

FIG. 3 shows an example cross-sectional view of a restrained column according to the above disclosed methods. As shown in FIG. 3, a steel I-beam core 310, which for example represents a column or a structural brace, is wrapped in a few layers of a desired sheet material 320, wherein a part or all of the overlapped surfaces of the wrapped sheet 320 is glued together to make a seamless jacket around the core 310. The optional spacers 330 and 340 help form an annular empty space between the jacket and the core to be filled with filler material 360. Because the filler material 360 does not stick to the surface of the I-beam 310, an optional bolt 370, as described above, is secured to the I-beam 310 to prevent the combination of the jacket 320 and the cured filler material 360 from freely moving over the I-beam 310.

Figure 4:
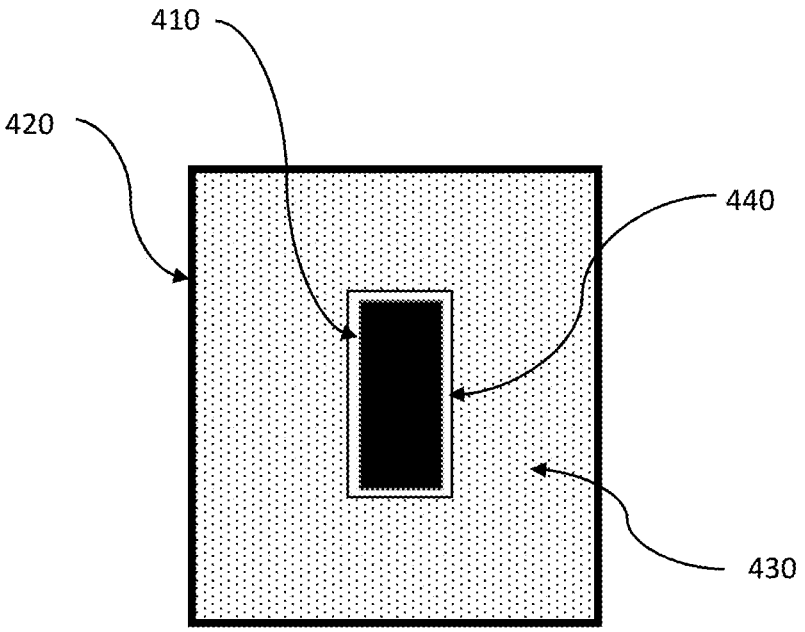
FIG. 4 shows an example of a traditional BRB (buckling restrained brace), using a prefabricated square profile.

In contrast, FIG. 4 shows an example of a traditional BRB (buckling restrained brace), using a prefabricated square profile 420 which can be only used when one or both ends of the column or the brace 410 are free/unattached. To use this traditional BRB, the prefabricated jacket 420 is slid over the steel core 410 from one of its free ends; a bond preventing agent or means 440 is used over the core 410; and a filler material 430 is poured in the space between the jacket 420 and the core 410. This traditional method is only possible during the construction of a new building and is impossible for reinforcing those columns and braces which are already fixed in place.

Figure 5:
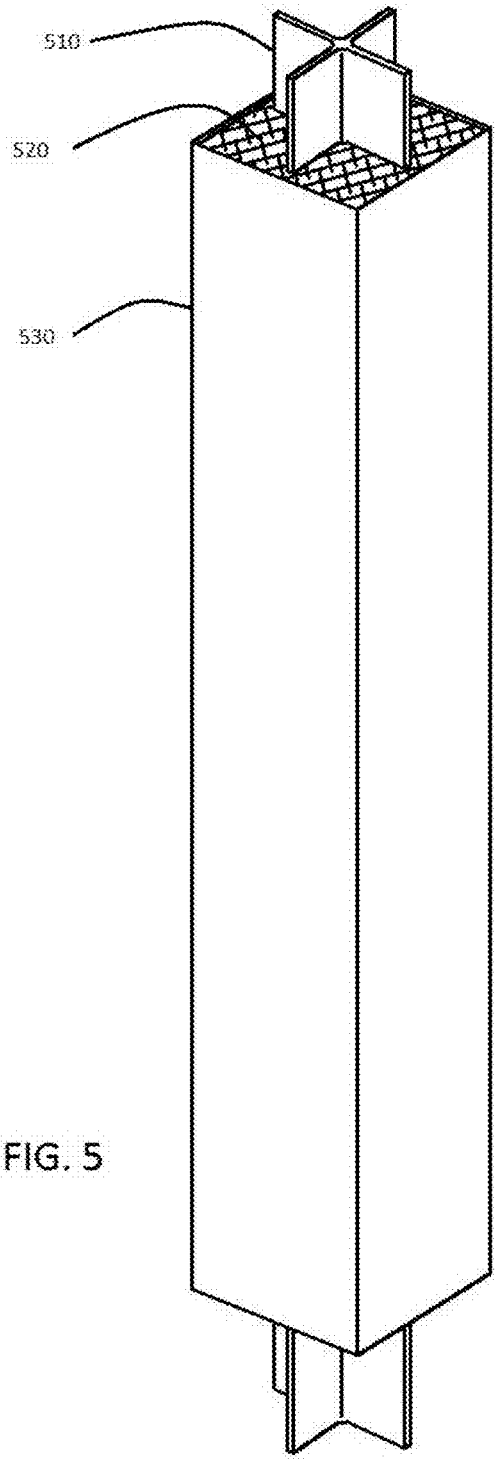
FIG. 5 is a 3-dimensional illustration of the traditional BRB (buckling restrained brace), using a prefabricated square profile.

FIG. 5 is a 3-dimensional illustration of the traditional BRB (buckling restrained brace), using a prefabricated square profile 530. In this figure, the prefabricated jacket 530 is slid over the steel core 510 from one of its free ends; a bond preventing agent or means is used over the core 510 to prevent the filler material to stick to the jacket 530, and a filler material 520 is poured in the space between the jacket 530 and the core 510. As mentioned above, this traditional method is only possible during the construction of a new building and is impossible for reinforcing those columns and braces which are already fixed at both ends.

In various embodiments the bottom end of the shell will be sealed prior to the placement of the grout. Those skilled in the art realize that there are many ways to achieve this, including custom-building a plate made with FRP fabric or 3D fabric similar to those used in construction of StifPipe® by QuakeWrap, Inc. Wood or other materials can also be used, as can a rubber or similar inflatable bladder that can be deflated and removed after the annular space is filled with grout.

Figure 6:
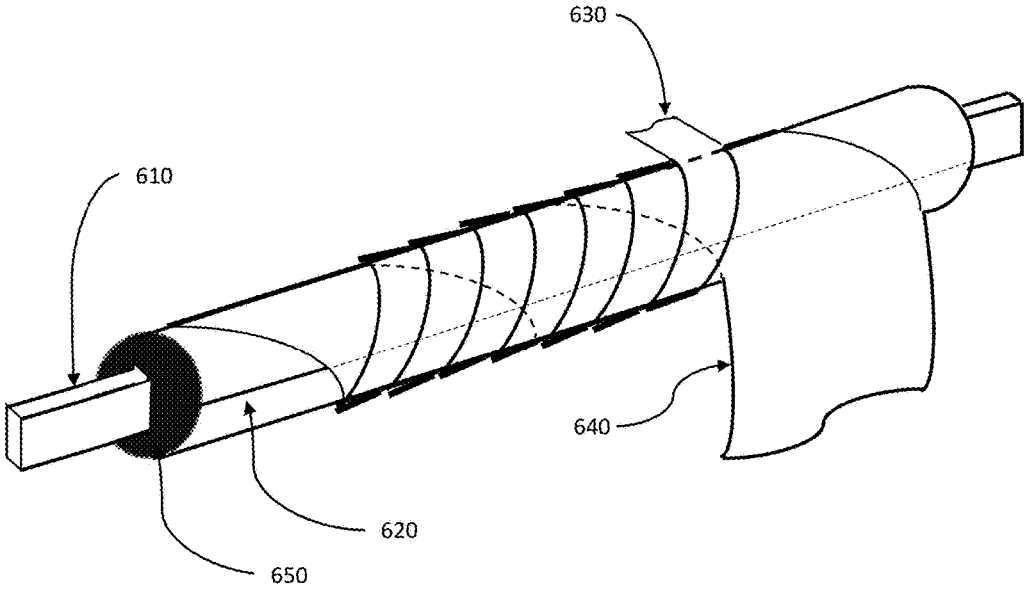
FIG. 6 shows an example of different methods of wrapping a jacket around a column or a structural brace.

In different embodiments the jacket sheet may either be wound around the core structural element in a spiral fashion or in a non-spiral fashion, or a combination of both. FIG. 6 shows an example of different methods of wrapping a jacket around a column or a structural brace. In FIG. 6, a first sheet 620 is wrapped around the core structural element 610 overlappingly, in a non-spiral manner. In this example, two additional layers 630 and 640 are wrapped spirally over sheet 620. In a formation such as that of FIG. 6, or similar formations, the first non-spiral or spiral layer, such as layer 620, may be a semi-flexible sheet of any material, for example a cardboard or a heavy-duty paper or a thin flexible HDPE sheet that can be formed into a temporary shell over which the other layers will be wound.

Figure 7:
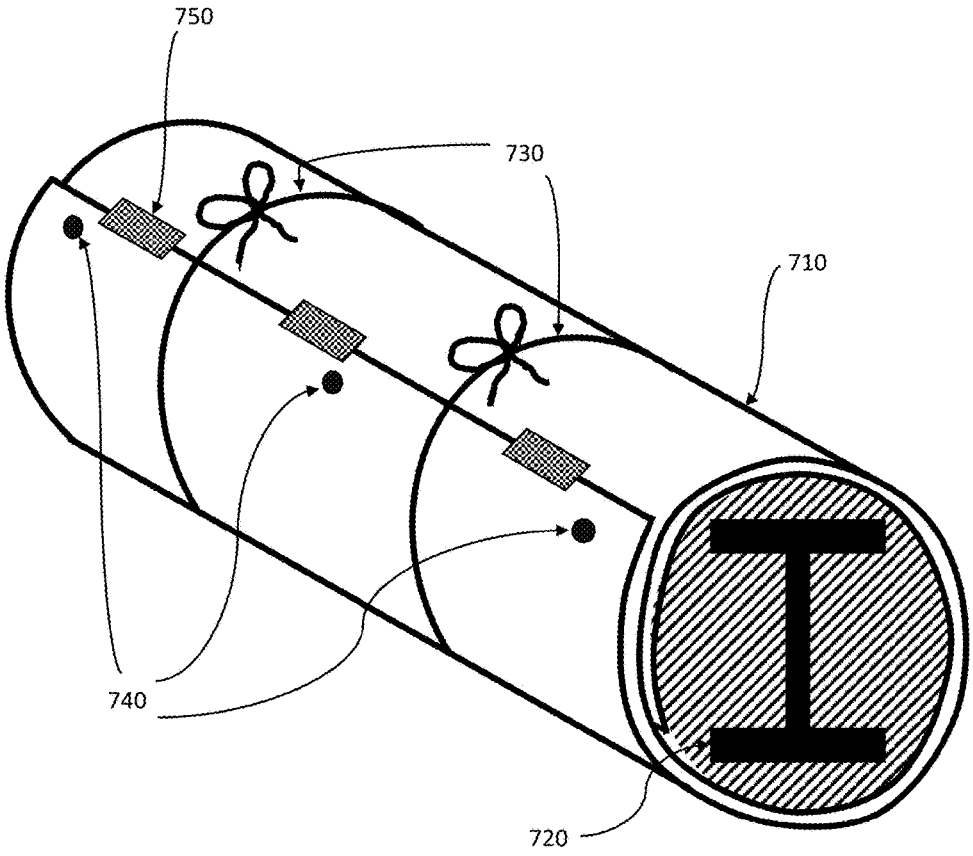
FIG. 7 shows an example of alternative methods of fixing a wrapped sheet around a column or a structural brace.

FIG. 7 shows an example of alternative methods of fixing a wrapped sheet around a column or a structural brace. In some embodiments, especially those in which the structural sheet is wrapped a few times around itself, adhesive may not be used at all to adhere the overlapped surfaces of the wrapped sheet together. In such embodiments the friction force between adjacent layers of the wrapped sheet is sufficient to keep the wrapped sheet from unwrapping as a result of the internal pressure of the jacket or other causes.

As a matter of fact, the internal pressures of the jacket exert perpendicular forces to the inner surface of the wrapped sheet which in turn causes stronger friction forces between the sheet layers and will make it harder for the sheet to unwrap. Of course, the higher the coefficient of friction of the structural sheet surfaces or the higher the number of the wrapped layers, the larger the friction forces will be between adjacent layers of the wrapped sheet. In the example embodiment shown in FIG. 7, a structural I-beam 720 is wrapped in a structural sheet 710 which instead of using any adhesive between its layers uses a couple of simple strings 730 and/or pins, rivets, nails, snaps, screws, static electricity, or a simple clamp 740 and/or uses adhesive tapes 750, or the like. In general, different embodiments may use any non-adhesive method to keep the sheet wrapped and prevent its unraveling. In various embodiments it is also possible to use both adhesives and fasteners.

It is important to note that while in all the above embodiments at least one layer of structural sheet has been wrapped around the structural member (column, brace, etc.), any non-structural sheet may also be used instead of a structural sheet as long as it is wrapped multiple times around the structural element. For example a first layer of heavy paper and multiple overlapping layers of kitchen aluminum foil or kitchen plastic wrap can construct a jacket which is as strong as one constructed by an FRP or by a thin steel sheet. Therefore, in various embodiments any flexible sheet of material may be used to make a seamless jacket around the structural member.

Changes can be made to the claimed invention in light of the above Detailed Description. While the above description details certain embodiments of the invention and describes the best mode contemplated, no matter how detailed the above appears in text, the claimed invention can be practiced in many ways. Details of the system may vary considerably in its implementation details, while still being encompassed by the claimed invention disclosed herein.

Particular terminology used when describing certain features or aspects of the disclosure should not be taken to imply that the terminology is being redefined herein to be restricted to any specific characteristics, features, or aspects of the disclosure with which that terminology is associated. In general, the terms used in the following claims should not be construed to limit the claimed invention to the specific embodiments disclosed in the specification, unless the above Detailed Description section explicitly defines such terms. Accordingly, the actual scope of the claimed invention encompasses not only the disclosed embodiments, but also all equivalent ways of practicing or implementing the claimed invention.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The above specification, examples, and data provide a complete description of the manufacture and use of the composition of the invention. Since many embodiments of the invention can be made without departing from the spirit and scope of the invention, the invention resides in the claims hereinafter appended. It is further understood that this disclosure is not limited to the disclosed embodiments, but is intended to cover various arrangements included within the spirit and scope of the broadest interpretation so as to encompass all such modifications and equivalent arrangements.

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

What is claimed is:

1. An apparatus for restraining a structural member against buckling, the apparatus comprising:

a) a seamless jacket around the structural member that resist compression and tension loads, constructed by overlappingly wrapping at least one flexible sheet of material around the structural member, wherein the jacket stays at a distance from the structural member to form an annular space between the jacket and the structural member and wherein overlapped surfaces of the flexible sheet of material are glued together;

b) a filler material to fill the annular space between the jacket and the structural member, wherein the cured filler material can slide over a surface of the structural member at least in one direction.

2. The apparatus of claim 1, wherein the structural member is made of steel.

3. The apparatus of claim 1, wherein the filler material is a non-shrink concrete or a cementitious grout.

4. The apparatus of claim 1, further including application of a debonding material to the surfaces of the structural member prior to introduction of the filler material.

5. The apparatus of claim 4, wherein the debonding material is grease or other non-water-soluble lubricants or is a thin plastic film that is applied over surfaces of the structural member as a solid or a paste or a liquid.

6. The apparatus of claim 1, wherein the flexible sheet of material is a structural or a non-structural sheet.

7. The apparatus of claim 1, wherein the flexible sheet of material is an FRP laminate, PileMedic® PLG60.60 glass, or PileMedic® PLC100.60 carbon laminate, or made of steel, and the adhesive is an epoxy paste, or QuakeBond™ J201TC Tack Coat.

8. The apparatus of claim 1, wherein prior to placement of the filler material, reinforcing elements are placed in the annular space.

9. The apparatus of claim 1, wherein the sheet is kept wrapped by adhesive, pins, rivets, nails, snaps, screws, adhesive tapes, static electricity, clamps, or a combination thereof.

10. The apparatus of claim 1, wherein a lower end of the annular space between the jacket and the structural member is closed before placement of the filler material.

* * * * *